United States Patent [19]

Czesnik et al.

[11] Patent Number: 5,048,986

[45] Date of Patent: Sep. 17, 1991

[54] SELF ALIGNING INKING ROLL FOR A PRINTER

[75] Inventors: Marek W. Czesnik, Kitchener; James A. Michael, Waterloo; Anthony J. Boon, Kitchener, all of Canada

[73] Assignee: NCR Corporation, Dayton, Ohio

[21] Appl. No.: 525,563

[22] Filed: May 18, 1990

[51] Int. Cl.[5] ..... B41J 31/14

[52] U.S. Cl. ..... 400/202; 400/197

[58] Field of Search ..... 400/191, 193, 194, 197, 400/198, 199, 200, 201, 202-202.4, 207, 208, 208.1

[56] References Cited

U.S. PATENT DOCUMENTS

| | | | |
|---|---|---|---|
| 2,755,905 | 7/1956 | Segui | 400/202 |
| 3,297,223 | 1/1967 | Bucker | 226/183 |
| 3,460,665 | 8/1969 | Dodsworth et al. | 400/202 |
| 3,542,303 | 11/1970 | Auld | 242/55.19 |
| 4,084,682 | 4/1978 | Fairey et al. | 400/197 |
| 4,340,313 | 7/1982 | Bishop | 400/202.1 |
| 4,536,098 | 8/1985 | Sheehan et al. | 400/202.4 |
| 4,568,210 | 2/1986 | Privitera | 400/235.1 |
| 4,636,097 | 1/1987 | Goubeaux | 400/202.4 |
| 4,732,500 | 3/1988 | Burgin | 400/208 |
| 4,913,571 | 4/1990 | Bulson et al. | 400/202.4 |

*Primary Examiner*—Edgar S. Burr
*Assistant Examiner*—Joseph R. Keating
*Attorney, Agent, or Firm*—Wilbert Hawk, Jr.; Albert L. Sessler, Jr.; Elmer Wargo

[57] ABSTRACT

A self-aligning inking roll for a printer which includes an inking roll, an ink transfer roll, a printer, and an endless ribbon mounted on the transfer roll and the printer so as to provide a fresh supply of ink thereto. The inking roll is mounted on an aligner member which is mounted on a support member, with the support member being mounted on an arm which is resiliently biased towards the transfer roll. The aligner member is mounted on the support member at the midpoint of the aligner member so as to provide a fulcrum area which enables the aligner member with the inking roll thereon to pivot and thereby establish a line contact with the transfer roll with the ribbon thereon.

11 Claims, 4 Drawing Sheets

SELF ALIGNING INKING ROLL FOR A PRINTER

BACKGROUND OF THE INVENTION (1) Field of the Invention

This invention relates to a self-aligning inking roll assembly for a printer.

(2) Background Information

In certain prior art printing devices, it is common to use an inking roll, a transfer roll, an endless ribbon, and a printer in a ribbon inker assembly. The endless ribbon partially surrounds the transfer roll and travels around the printer in operative engagement therewith, and the inking roll is resiliently biased against the endless ribbon which partially surrounds the transfer roll. In order to insure an even transfer of ink from the inking roll to the ribbon on the transfer roll, it is necessary that the inking roll establish a "line contact" with the portion of the ribbon on the transfer roll.

With some prior art devices, one way to establish the line contact was to use close manufacturing tolerances to mount the inking roll and the transfer roll so that their associated longitudinal axes were parallel to each other. This approach was expensive and did not provide the even transfer of ink on the ribbon anticipated.

SUMMARY OF THE INVENTION

To obviate the problems mentioned in the Background, the ribbon inker assembly of the present invention utilizes a construction which enables the inking roll to establish a line of contact with the portion of the ribbon on the transfer roll so as to provide for an even transference of ink to the ribbon. This construction can be effected with relatively loose manufacturing tolerances so as to provide an assembly which is low in cost and easy to assemble. Another advantage of this construction is that it employs a inking roll which is pivotally mounted on a support member at approximately the midpoint of the inking roll so as to provide a "self-aligning" feature of the inking roll relative to the transfer roll with the ribbon thereon.

In one aspect of a preferred embodiment of the invention, there is provided in a ribbon inker assembly, a combination comprising:

a frame having a transfer roll mounted thereon;

an aligner member for supporting an inking roll;

a support member for supporting said aligner member; and supporting means for supporting said support member for biasing movement towards said transfer roll;

said support member having a bearing surface and a centering portion; and said aligner member having a support portion having an opening therein to receive said centering portion of said support member and also having a mating bearing surface to contact said bearing surface of said support member to support said aligner member on said support member.

In another aspect of a preferred embodiment of the invention, there is provided a ribbon inker assembly comprising:

a frame;

a transfer roll having a longitudinal axis and being rotatably mounted on said frame;

an arm having first and second ends, with said first end being pivotally mounted on said frame;

a support member having a longitudinal axis, with said support member being mounted on said second end of said arm to enable the longitudinal axis of said support member to be parallel to the longitudinal axis of said transfer roll;

an aligner member mounted on said support member and being shaped to receive an ink roll;

an inking roll mounted on said aligner member;

said support member having a bearing surface and a centering portion;

said aligner member having a supporting portion having an opening therein to receive said centering portion and also having a mating bearing surface to contact said bearing surface of said support member to support said aligner member on said support member;

a printer;

an inking ribbon partially surrounding said transfer roll and being operatively coupled to said printer for supplying ink thereto;

drive means coupled to said transfer roll for rotating said transfer roll; and biasing means to bias the second end of said arm towards said transfer roll to bias said inking roll into engagement with the inking ribbon partially surrounding said transfer roll.

The above advantages and others will be more readily understood in connection with the following description, claims, and drawing.

DESCRIPTION OF THE PREFERRED EMBODIMENT

Figure 1:
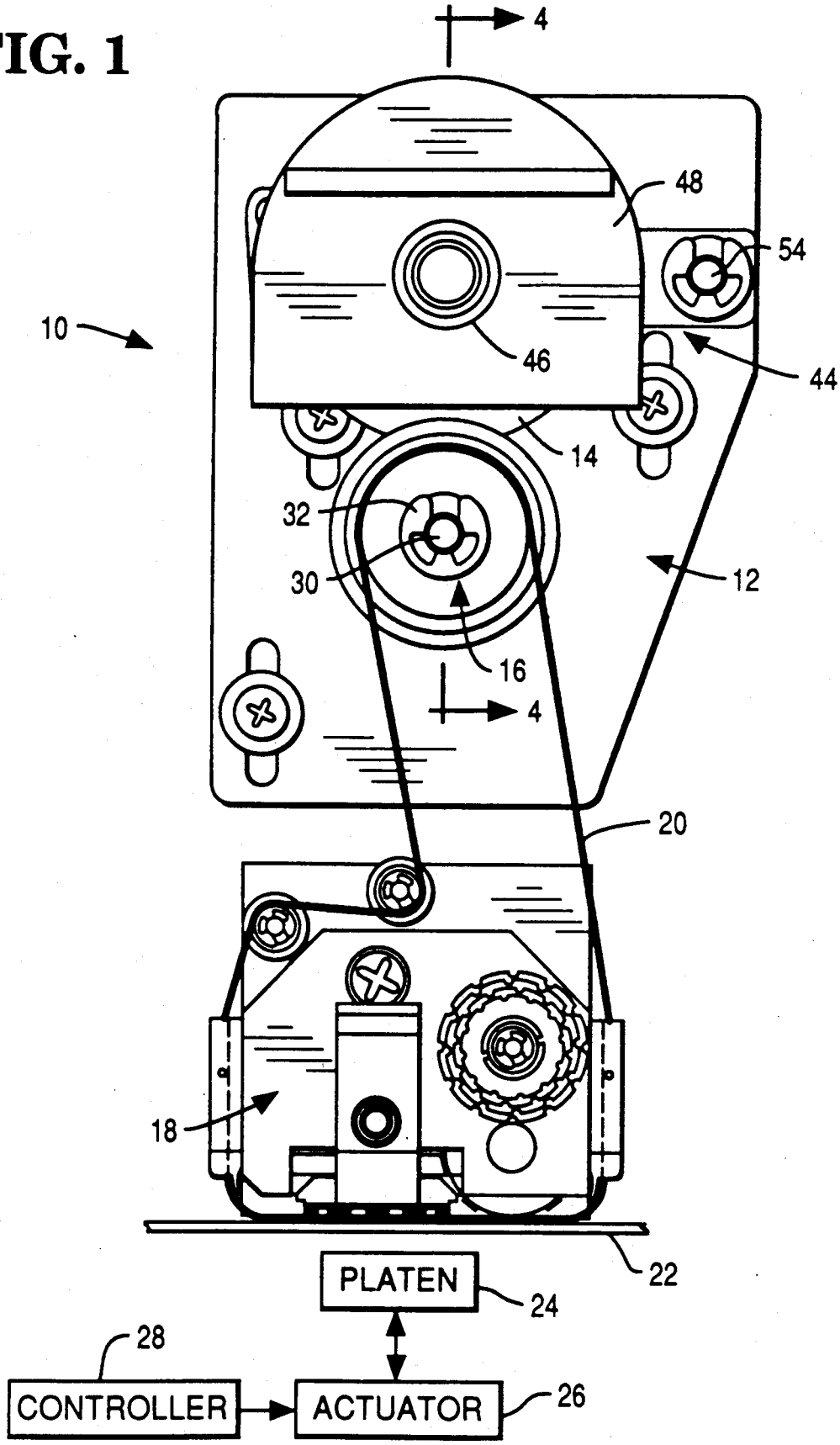
FIG. 1 is a general plan view of a preferred embodiment of this invention showing a frame, an inking roll, a transfer roll, a print head, and an endless ribbon partially surrounding the transfer roll and extending around the print head in operative relationship therewith.

FIG. 1 is a general plan view of a preferred embodiment of this invention showing a ribbon inker assembly (hereinafter referred to as assembly 10) including a planar frame 12, an inking roll 14, a transfer roll 16, a print head 18, and an endless ink ribbon 20. The ribbon 20 partially surrounds the transfer roll 16 and extends around the print head 18 in operative relationship therewith. A document 22 to be printed upon, a platen 24, an actuator 26 (to move the platen against the print head 18), and a controller 28 are shown to orient the assembly 10 in a typical environment.

Figure 2:
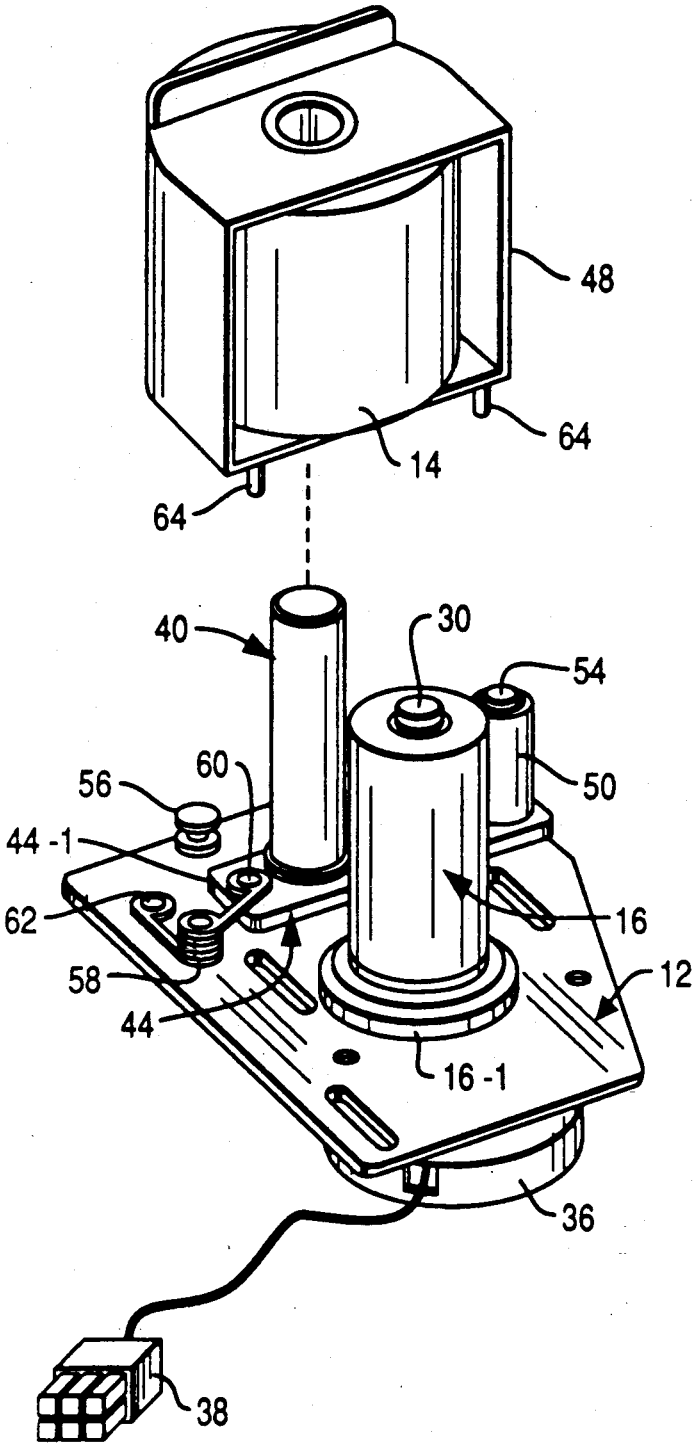
FIG. 2 is a general exploded perspective view showing the inking roll positioned above an aligner member on which the inking roll is mounted.
Figure 3:
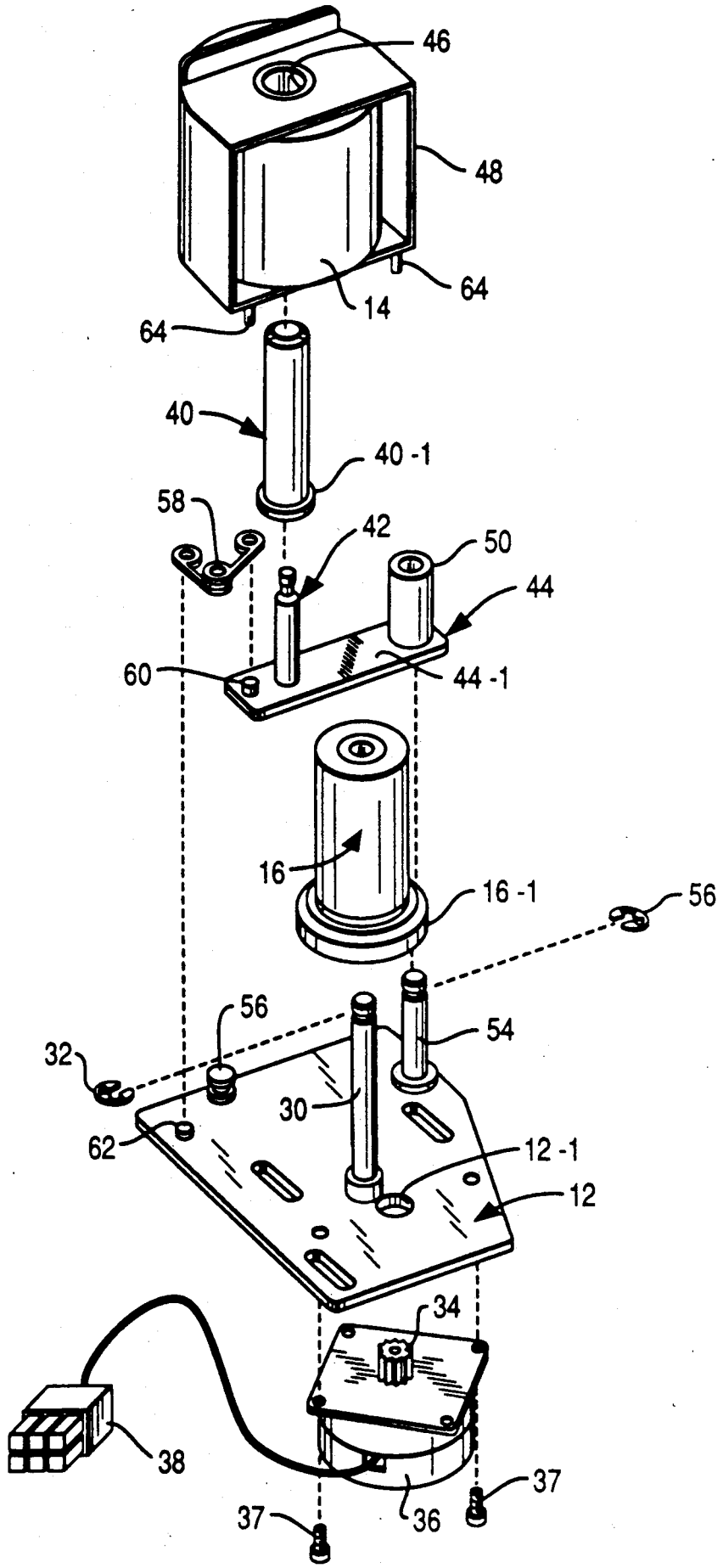
FIG. 3 is a general exploded view, similar to FIG. 2, showing additional details of the invention.
Figure 4:
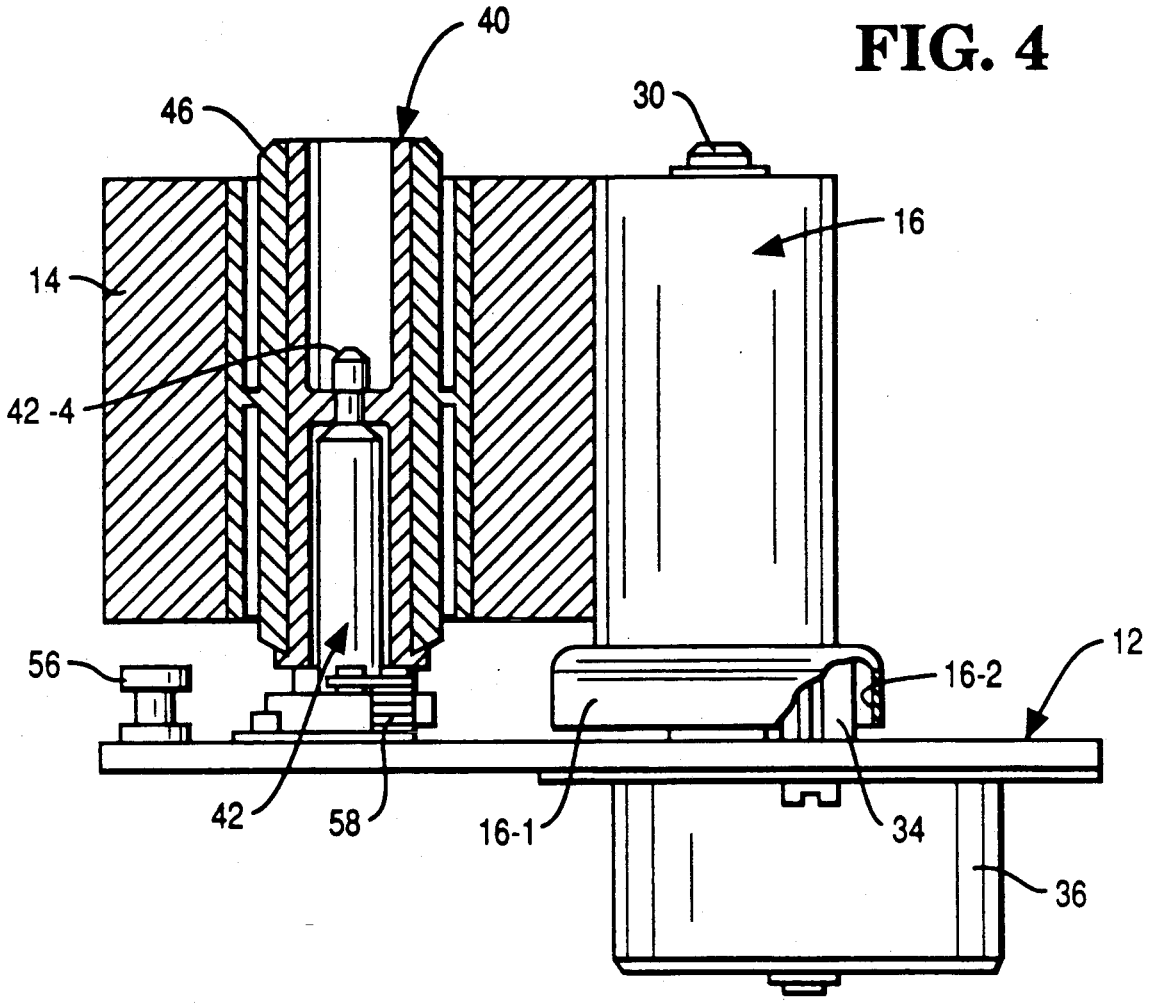
FIG. 4 is a general cross-sectional view, taken along the line 4—4 of FIG. 1, to show additional details of the invention.

FIGS. 2 and 3 are exploded perspective views which show how the various elements of the assembly 10 are assembled. The transfer roll 16, which is made of plastic, is rotatably mounted on a post 30 so that the associated longitudinal axis of the transfer roll 16 is perpendicular to the frame 12. The post 30 is perpendicular to and upstanding from the frame 12, and a "C"-clip 32 (FIG. 3) is used to retain the transfer roll 16 thereon. The lower end of the transfer roll 16 has a flange portion 16-1 which houses an internal ring gear 16-2 (FIG. 4). An opening 12-1 (FIG. 3) in the frame 12 permits the output gear 34 of a stepping motor 36 to pass therethrough and to mesh with the internal ring gear 16-2 of the transfer roll 16. A connection terminal 38 is used to couple the stepping motor 36 to the controller 28, and fasteners 37 are used to secure the stepping motor 36 to the frame 12. When the stepping motor 36 is energized by the controller 28, the transfer roll 16 is rotated to advance the endless ribbon 20 to provide a fresh supply of inked ribbon to the print head 18. The internal ring gear 16-2, the stepping motor 36, and the controller 28 provide a drive means for rotating the transfer roll 16.

The assembly 10 also includes an aligner member 40 (FIG. 3) for supporting the inking roll 14, a support member 42 for supporting the aligner member 40, and a supporting means 44 for supporting the supporting member 42 for biasing movement towards the transfer roll 16.

The aligner member 40 (FIG. 3) is made of a tough, resilient plastic material like Delrin, and it is made in the general form of a cylindrical sleeve. The inking roll 14 is rotatably mounted on a cylindrical sleeve 46 which is secured in a housing 48 to provide a means for handling the inking roll 14 without getting one's hands soiled. The outer diameter of the aligner member 40 is dimensioned to receive the internal diameter of the sleeve 46 associated with the inking roll 14, and the lower end of the aligner member 40 has a flange 40-1 thereon to support the inking roll 14 and the housing 48 thereon.

The supporting means 44 for supporting the support member 42 includes an arm 44-1 shown best in FIG. 3. The arm 44-1 has a first end on which a mounting bushing 50 is secured to enable the first end of the arm 44-1 to be pivotally mounted on a post 54 which is upstanding from and perpendicular to the frame 12. A "C"-clip 56 is used to retain the arm 44-1 and bushing 50 on the frame 12. The second end or free end of the arm 44-1 has the support member 42 fixed thereto so that the longitudinal axis of the support member 42 is parallel to the longitudinal axis of the transfer roll 16.

The arm 44-1 can be pivoted between the operative position shown in FIG. 1 and an inoperative position which is not shown. When in the operative position, the inking roll 14 is in operative engagement with the ribbon 20 on the transfer roll 16. From this position, the arm 44-1 can be pivoted to the inoperative position (not shown) in which the arm 44-1 is pivoted in a clockwise direction (as viewed in FIG. 2) to bring the arm 44-1 into engagement with a stop 56 upstanding from the frame 12. A torsion spring 58 (FIG. 2) has one end thereof secured to a stud 60 located on the second end of the arm 44-1, and the remaining end thereof is secured to a stud 62 upstanding from the frame 12. The torsion spring 58 is used to bias the arm 44-1 towards the transfer roll 16 so as to bring the inking roll 14 into operative engagement with the ribbon 20 and the transfer roll 16. Also, the torsion spring 58 and the stop 56 are positioned relative to the arm 44-1 to establish an over-the-center position when the arm 44-1 rests against the stop 56; this facilitates removing a used inking roll 14 along with its housing 48 and replacing them with a new unit.

Figure 5:
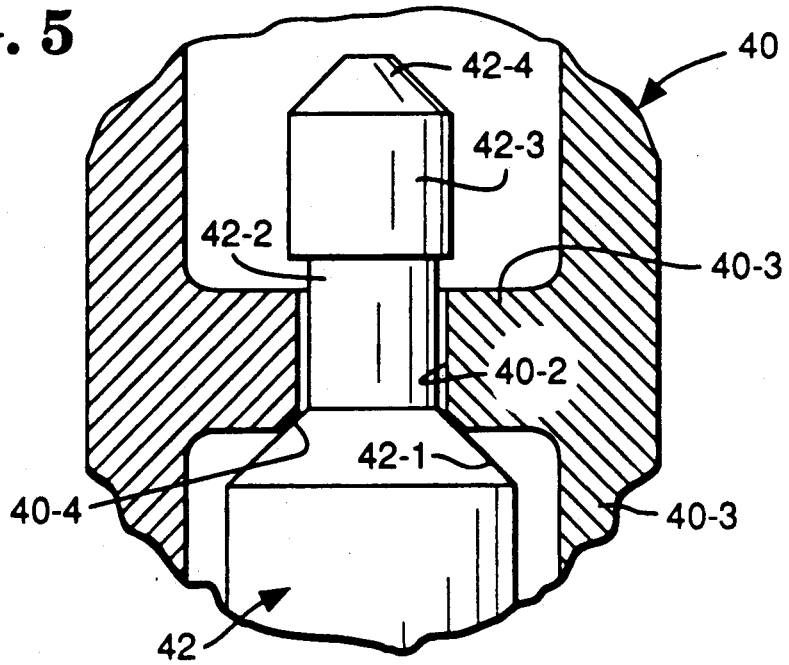
FIG. 5 is an enlarged view showing a portion of FIG. 4.

The support member 42 provides bearing, centering, and retaining functions for the aligner member 40. In this regard, the support member 42 has a conically shaped bearing surface 42-1, a reduced diameter portion 42-2, and an enlarged diameter portion 42-3 on the upper end thereof as viewed in FIG. 5. The reduced diameter portion 42-2 and the enlarged diameter portion 42-3 are described relative to a cylindrical hole 40-2 located in a support area 40-3 of the aligner member 40. The support area 40-3 also has a mating bearing surface 40-4 which is conically shaped to rest on the conically shaped bearing surface 42-1 of the support member 42 when in the assembled relationship shown in FIG. 5.

In the embodiment described, the conically shaped surface 42-1 (FIG. 5) appears at an angle of 45 degrees relative to the longitudinal axis of the support member 42; the same is true for the bearing surface 40-4 located on the aligner member 40. The enlarged diameter portion 42-3 has a chamfer 42-4 on the end thereof to enable the aligner member 40 to be pushed on the support member 42 as shown in the assembled relationship shown in FIG. 5. Because the aligner member 40 is made of a resilient plastic material, the cylindrical hole 40-2 can be stretched somewhat to enable the enlarged diameter portion 42-3 to pass therethrough and thereby retain the aligner member 40 on the support member 42. The support area 40-3 is located at substantially the midpoint of the aligner member 40 as measured along its longitudinal axis. The reduced diameter portion 42-2 keeps the aligner member 40 centered on the support member 42, and the bearing surface 42-1 and the mating bearing surface 40-4 provide a fulcrum area to enable the aligner member 40 to pivot about its midpoint relative the transfer roll 16. This pivoting action enables the inking roll 14 to establish a "line contact" with the transfer roll 16 and the ribbon 20 thereon. Establishing line contact in this manner is a feature of this invention.

The controller 28 energizes the stepping motor 36 whenever fresh ribbon is to be advanced to the print head 18, causing the transfer roll 16 to be incrementally rotated. As the transfer roll 16 is rotated, the inking roll 14 in contact therewith is also rotated, bringing a new portion of the inking roll 14 in contact with the ribbon 20. The underside of the housing 48 has projections 64 (FIG. 3) depending therefrom to engage a side of the arm 44-1 to prevent the housing 48 from rotating while the inking roll 14 rotates.

What is claimed is:

1. In a ribbon inker assembly, a combination comprising:

a frame having a transfer roll mounted thereon;

an aligner member for supporting an inking roll;

a support member for supporting said aligner member; and supporting means for supporting said support member for biasing movement towards said transfer roll;

said support member having a bearing surface and a centering portion; and said aligner member having a support portion having an opening therein to receive said centering portion of said support member and also having a mating bearing surface to contact said bearing surface of said support member to support said aligner member on said support member.

2. The combination as claimed in claim 1 in which said bearing surface is conically shaped and said centering portion is cylindrically shaped.

3. The combination as claimed in claim 2 in which said aligner member is generally cylindrical in shape and has a flange on one end thereof.

4. In a ribbon inker assembly, a combination comprising:

a frame;

a transfer roll having a longitudinal axis and being rotatably mounted on said frame;

an arm having first and second ends, with said first end being pivotally mounted on said frame;

a support member having a longitudinal axis, with said support member being mounted on said arm to enable the longitudinal axis of said support member to be parallel to the longitudinal axis of said transfer roll;

an aligner member mounted on said support member and being shaped to receive an inking roll;

said support member having a bearing surface and a centering portion;

said aligner member having a supporting portion having an opening therein to receive said centering portion and also having a mating bearing surface to contact said bearing surface of said support member to support said aligner member on said support member; and biasing means to bias the second end of said arm towards said transfer roll.

5. The combination as claimed in claim 4 in which said bearing surface is conically shaped and said centering portion is cylindrically shaped.

6. The combination as claimed in claim 5 in which said aligner member is generally cylindrical in shape and has a flange on one end thereof.

7. The combination as claimed in claim 5 in which:

said support member has a cylindrical portion having a diameter;

said opening in said aligner member is cylindrical in shape having a diameter which is smaller than the diameter of said cylindrical portion;

said centering portion is located between said bearing surface and said cylindrical portion of said support member; and said aligner member and said support member are made of resilient material to enable said cylindrical portion to be moved through said opening in said aligner member to enable said aligner member to be detachably retained on said support member.

8. The combination as claimed in claim 7 in which said aligner member has a longitudinal axis and a length which is measured along its associated said longitudinal axis, and said mating bearing surface is located at approximately the midpoint of the length of said aligner member, said bearing surface and said mating bearing surface together providing a fulcrum area to enable said aligner member to pivot thereon to enable the inking roller mounted on said aligner member to form a line contact with an inking ribbon partially surrounding said transfer roll.

9. A ribbon inker assembly comprising:

a frame;

a transfer roll having a longitudinal axis and being rotatably mounted on said frame;

an arm having first and second ends, with said first end being pivotally mounted on said frame;

a support member having a longitudinal axis, with said support member being mounted on said second end of said arm to enable the longitudinal axis of said support member to be parallel to the longitudinal axis of said transfer roll;

an aligner member mounted on said support member and being shaped to receive an inking roll;

an inking roll mounted on said aligner member;

said support member having a bearing surface and a centering portion;

said aligner member having a supporting portion having an opening therein to receive said centering portion and also having a mating bearing surface to contact said bearing surface of said support member to support said aligner member on said support member;

a printer;

an inking ribbon partially surrounding said transfer roll and being operatively coupled to said printer for supplying ink thereto;

drive means coupled to said transfer roll for rotating said transfer roll; and biasing means to bias the second end of said arm towards said transfer roll to bias said inking roll into engagement with the inking ribbon partially surrounding said transfer roll.

10. The ribbon inker assembly as claimed in claim 9 in which said bearing surface is conically shaped and said centering portion is cylindrically shaped.

11. The combination as claimed in claim 10 in which said aligner member is generally cylindrical in shape and has a flange on one end thereof to support said inking roll.

* * * * *